US005756443A

United States Patent [19]

Inoue et al.

[11] Patent Number: 5,756,443

[45] Date of Patent: May 26, 1998

[54] DETERGENT COMPOSITION FOR HARD SURFACE

[75] Inventors: Takumi Inoue, Tochigi; Naoki Iso, Mooka; Kazunori Tsukuda, Utsunomiya, all of Japan

[73] Assignee: Kao Corporation, Tokyo, Japan

[21] Appl. No.: 790,893

[22] Filed: Jan. 29, 1997

Related U.S. Application Data

[63] Continuation of Ser. No. 490,668, Jun. 15, 1995, abandoned.

[30] Foreign Application Priority Data

Aug. 22, 1994 [JP] Japan ..... 6-196621

[51] Int. Cl.[6] ..... C11D 1/62

[52] U.S. Cl. ..... 510/238; 510/362; 510/423; 510/424; 510/432; 510/433; 510/434; 510/477; 510/480; 510/504

[58] Field of Search ..... 510/238, 362, 510/423, 424, 432, 433, 434, 477, 480, 504

[56] References Cited

U.S. PATENT DOCUMENTS

| | | | |
|---|---|---|---|
| H269 | 5/1987 | Malik | 422/37 |
| 3,223,643 | 12/1965 | Law | 252/106 |
| 4,020,016 | 4/1977 | Sokol | 252/546 |
| 4,455,250 | 6/1984 | Frazier | 252/106 |
| 4,540,505 | 9/1985 | Frazier | 252/106 |
| 4,561,998 | 12/1985 | Wertz et al. | 252/547 |
| 4,601,954 | 7/1986 | Coleman | 428/522 |
| 4,661,523 | 4/1987 | Disch et al. | 514/635 |
| 4,836,986 | 6/1989 | Ogunbiyi et al. | 422/28 |
| 4,965,063 | 10/1990 | Casey et al. | 424/7.1 |
| 5,230,823 | 7/1993 | Wise et al. | 252/174.21 |
| 5,435,935 | 7/1995 | Kupneski | 252/156 |

FOREIGN PATENT DOCUMENTS 342997 11/1989 European Pat. Off. .

639636 2/1995 European Pat. Off. .

OTHER PUBLICATIONS

English Abstract of JP Laid Open Appln. No. 283700/1986, Dec. 13.

English Abstract of JP Laid Open Appln. No. 221497/1989, Apr. 9.

*Primary Examiner*—Douglas J. McGinty
*Assistant Examiner*—John R. Hardee
*Attorney, Agent, or Firm*—Birch, Stewart, Kolasch & Birch, LLP

[57] ABSTRACT

A detergent composition for hard surfaces includes (a) 0.1–30 wt. % of a cationic surfactant represented by the general formula (1) or (2):

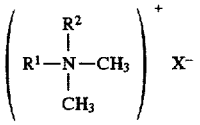

(1)

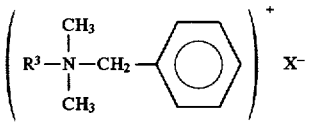

(2)

wherein $R^1$ is a linear or branched alkyl or alkenyl group having 6–11 carbon atoms, $R^2$ is a methyl group or a linear or branched alkyl or alkenyl group having 6–11 carbon atoms, $R^3$ is a linear or branched alkyl or alkenyl group having 6–11 carbon atoms, and X is a halogen atom or a residue of an alkylsulfuric acid; (b) 0.1–20 wt. % of a sequestering agent; and (c) 0.1–20 wt. % of a water-soluble solvent. The composition has a pH of 3–12. Since the detergent composition is excellent in the ability to decompose and solubilize metallic soap scum, the dirt on a bathtub and the like in a bathroom can be quickly and easily cleansed off.

11 Claims, No Drawings

DETERGENT COMPOSITION FOR HARD SURFACE

This application is a continuation of application Ser. No. 08/490,668 filed on Jun. 15, 1995, now abandoned.

BACKGROUND OF THE INVENTION

1. Field of the Invention

The present invention relates to a detergent composition for hard surfaces, and more particularly to a detergent composition which has good detergency to scummy dirt or smears on the hard surfaces of bathrooms and the like.

2. Description of the Background Art

As detergents for hard surfaces, in particular, bathrooms and bathtubs, there are widely used acid detergents composed mainly of a nonionic surfactant, an anionic surfactant, an organic acid and a solvent; neutral detergents comprising in combination a nonionic surfactant and an anionic surfactant; and alkaline detergents composed mainly of a nonionic surfactant, an anionic surfactant and a sequestering agent.

However, the dirt in bathrooms and on bathtubs is different in the component of dirt from any other dirt in houses and is composed mainly of a metallic soap, particularly, the calcium salt of a fatty acid, to which proteins, nucleic acids and oils such as lipids are bonded. Although this metallic soap scum cannot be decomposed by conventional neutral detergents and alkaline detergents, it can be decomposed by acid detergents. However, acid detergents have problems such as difficultly in rinsing due to redeposition of the dirt after cleaning, damage to bathtubs and the like are damaged, and hand roughening is caused.

From such a point of view, it has been attempted to develop detergents excellent in detergency to metallic soap scum. As a result, there have been reported a neutral detergent comprising in combination a cationic surfactant and a nonionic surfactant (Japanese Patent Application Laid-Open No. 283696/1986), a detergent comprising in combination a cationic surfactant, a nonionic surfactant and a water-soluble solvent (Japanese Patent Application Laid-Open No. 283697/1986), a detergent comprising in combination a cationic surfactant, a nonionic surfactant and maleic acid (Japanese Patent Application Laid-Open No. 283700/1986), a detergent for bathrooms comprising in combination a cationic surfactant, a nonionic surfactant, an aminocarboxylic acid and a solvent (Japanese Patent Application Laid-Open No. 221497/1989), a detergent for bathrooms comprising in combination a sequestering agent and a glycol ether (Japanese Patent Application Laid-Open No. 22397/1981), etc.

However, it is not yet said that these detergents have full satisfactory detergency for metallic soap scum. Therefore, cleansing a bathroom or the like with such a detergent requires rubbing a surface to be cleansed with a sponge or the like. In addition, conventional detergents in which a quaternary ammonium salt is incorporated have involved a problem in that they are irritating to the skin.

SUMMARY OF THE INVENTION

Accordingly, it is an object of the present invention to provide a detergent composition, which can easily remove dirt or smears composed mainly of metallic soap scum on a hard surface of, in particular, a bathroom or the like and are not irritating to the skin.

The present inventors have carried out various investigations as to the relationship between the detergency to dirt composed of metallic soap scum combined with oil, and the chemical structure of a cationic surfactant. As a result, it has been found that the combined use of a quaternary monoalkyl (or monoalkenyl)trimethylammonium or dialkyl (or dialkenyl)dimethylammonium salt, or a quaternary monoalkyl(or alkenyl)benzyldimethylammonium salt, the alkyl or alkenyl moiety of which has a relatively short chain length of 6–11 carbon atoms, with a sequestering agent and a water-soluble solvent provides excellent detergency when compared with compositions where any other cationic surfactant is used in combination. The inventive composition is also not irritating to the skin, thus leading to the completion of the present invention.

It has also been revealed that the combined use of the above components with an anionic surfactant having a polyoxyalkylene group further improves detergency not only to the dirt of the metallic soap scum, but also to sebum smears.

It has been further found that when a nonionic surfactant and/or an amphoteric surfactant is incorporated in addition to the above components and the anionic surfactant having a polyoxyalkylene group, the detergency to the dirt of metallic soap scum and to the smears of sebum can be further improved, and storage stability is also improved.

According to the present invention, there is thus provided a detergent composition for hard surfaces, comprising the following components (a), (b) and (c):

(a) 0.1–30 wt. % of a cationic surfactant represented by the general formula (1) or (2):

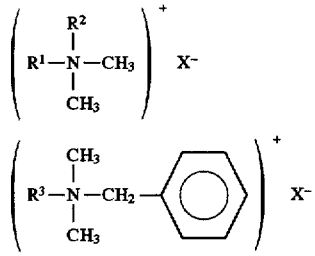

(1)

(2)

wherein $R^1$ is a linear or branched alkyl or alkenyl group having 6–11 carbon atoms, $R^2$ denotes a methyl group or a linear or branched alkyl or alkenyl group having 6–11 carbon atoms, $R^3$ stands for a linear or branched alkyl or alkenyl group having 6–11 carbon atoms, and X is a halogen atom or a residue of an alkylsulfuric acid;

(b) 0.1–20 wt. % of a sequestering agent; and (c) 0.1–20 wt. % of a water-soluble solvent, said composition having a pH of 3–12.

According to the present invention, there is also provided a detergent composition for hard surfaces, further comprising (d) an anionic surfactant having a polyoxyalkylene group in addition to components (a), (b) and (c), said composition having a pH of 3–12.

According to the present invention, there is further provided a detergent composition for hard surfaces, further comprising (e) a nonionic surfactant and/or an amphoteric surfactant in addition to the components (a), (b), (c) and (d), said composition having a pH of 3–12.

Since the detergent compositions for hard surfaces according to the present invention are excellent in the ability to decompose and solubilize metallic soap scum and sebum, the dirt on a bathtub and the like in a bathroom can be quickly and easily cleansed off. Moreover, they have good long-term storage stability.

The above and other objects, features and advantages of the present invention will be readily appreciated from the preferred embodiments of the present invention, which will be described subsequently in detail.

DETAILED DESCRIPTION OF THE INVENTION AND PREFERRED EMBODIMENTS

The cationic surfactant of component (a) serves to decompose and solubilize metallic soap scum when used in combination with a sequestering agent. In the present invention, it is important for such a surfactant to have the structure represented by the general formula (1) or (2). More specifically, the linear or branched alkyl or alkenyl group indicated by $R^1$ or $R^2$ in the general formula (1) has a chain length of 6–11 carbon atoms, more preferably 8–10 carbon atoms, and most preferably 8 carbon atoms. Such $R^1$ and $R^2$ groups are preferably linear or branched alkyl groups, with linear alkyl groups having 8–10 carbon atoms, in particular, octyl groups being more preferred. As the cationic surfactant of the general formula (1), is preferred a quaternary dialkyldimethylammonium salt in which both $R^1$ and $R^2$ are linear or branched alkyl or alkenyl groups having 6–11 carbon atoms.

On the other hand, the linear or branched alkyl or alkenyl group indicated by $R^3$ in the general formula (2) has a chain length of 6–11 carbon atoms, more preferably 8–10 carbon atoms, and most preferably 8 carbon atoms. Such a $R^3$ group is preferably a linear or branched alkyl group, with a linear alkyl group, in particular, a linear alkyl group having 8 carbon atoms being more preferred. Cationic surfactants of formula I on II wherein any of $R^1$–$R^3$ has 12 or more carbon atoms are strongly irritating to the skin and are hence unsuitable for use in a detergent for hard surfaces of a bathroom or the like.

Examples of X indicative of a counter ion in these cationic surfactants include a bromine atom, an iodine atom and a chlorine atom when X is a halogen atom, and methanesulfonic acid and ethanesulfonic acid when X is a residue of an alkylsulfuric acid. Of these, a halogen atom, in particular, a bromine or chlorine atom is preferred.

The component (a) is preferably incorporated in a proportion of 0.1–30 wt. %, more preferably 0.3–15 wt. %, most preferably 0.5–10 wt. % of the composition according to the present invention. Any proportion lower than 0.1 wt. % results in a detergent composition insufficient in detergency to scum. On the other hand, if the component (a) is incorporated in any proportion exceeding 30%, the effects of the present invention can no longer be enhanced. It is therefore uneconomical to incorporate component (a) in such a high proportion.

No particular limitation is imposed on the sequestering agent component (b) so long as it has the ability to chelate and sequestrate metal ions. However, examples thereof include hydroxycarboxylic acids and salt thereof, and aminocarboxylic acids and salts thereof. Of these, ethylenediaminetetraacetic acid, hydroxyethylethylenediaminetriacetic acid, citric acid and salts of these compounds are particularly preferred.

The component (b) is preferably incorporated in a proportion of 0.1–20 wt. %, more preferably 0.5–10 wt. %, most preferably 1–5 wt. % of the composition according to the present invention. Any proportion lower than 0.1 wt. % results in a detergent composition insufficient in detergency to scum. On the other hand, if the component (b) is incorporated in any proportion exceeding 20%, the effects of the present invention can no longer be enhanced.

No particular limitation is imposed on the water-soluble solvent component (c) useful in the practice of this invention. However, it may preferably comprise one or more water-soluble solvents selected from compounds represented by the following general formulae (3) through (5), dihydric alcohols having 4–12 carbon atoms and monohydric alcohols having 1–5 carbon atoms:

$$R^4O(C_2H_4O)_m(C_3H_6O)_nR^5 \quad (3)$$

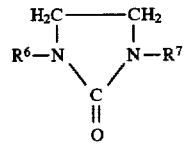

(4)

$$R^8OC(CH_3)_2CH_2CH_2OH \quad (5)$$

wherein $R^4$ and $R^5$ each individually are a hydrogen atom, an alkyl group having 1–8 carbon atoms, a phenyl group or a benzyl group, with the proviso that both $R^4$ and $R^5$ groups are not hydrogen atoms at the same time, m and n stand individually for an integer of 0–10, with the proviso that both m and n are not integers of 0 at the same time, $R^6$ and $R^7$ each individually are an alkyl group having 1–3 carbon atoms, and $R^8$ is an alkyl group having 1–3 carbon atoms.

In the water-soluble solvent represented by the general formula (3), it is particularly preferable for $R^4$ and $R^5$ to have 1–4 carbon atoms when they are alkyl groups. In formula (3), m and n mean respectively the average numbers of moles of ethylene oxide (E.O.) and propylene oxide (P.O.) added, and may be each individually 0–10. No particular limitation is imposed on the sequence of addition of these oxides. Therefore, the addition may be conducted at random. Specific preferable examples of the compounds of the formula (3) include propylene glycol monomethyl ether, diethylene glycol monobutyl ether, propylene glycol monobutyl ether, dipropylene glycol monobutyl ether and polyoxyethylene glycol (p=1–4) phenyl ether from the viewpoint of detergency and feel upon use of the resulting detergent composition.

Preferable examples of the compounds represented by the general formula (4) include 1,3-dimethyl-2-imidazolidinone and 1,3-diethyl-2-imidazolidinone. On the other hand, 3-methoxy-3-methylbutanol, 3-ethoxy-3-methyl-butanol and the like are preferred as compounds represented by the general formula (5).

Examples of dihydric alcohols having 4–12 carbon atoms include isoprene glycol, 2,2,4-trimethyl-1,3-pentanediol and the like.

Examples of monohydric alcohols having 1–5 carbon atoms include methanol, ethanol, isopropyl alcohol and the like. When these lower alcohols are incorporated, the low-temperature stability of the resulting composition is improved.

The water-soluble solvent component (c) is preferably incorporated in a proportion of 0.1–20 wt. %, more preferably 1–15 wt. %, most preferably 5–10 wt. % of the composition according to the present invention. Any proportion lower than 0.1 wt. % results in a detergent composition insufficient in detergency to the dirt other than scum, such as oil and grease smears. On the other hand, if component (c) is incorporated in any proportion exceeding 20%, the effects of the present invention can no longer be enhanced.

In the detergent composition for hard surfaces according to the present invention, the incorporation of (d) an anionic surfactant having a polyoxyalkylene group in addition to the above-described components (a), (b) and (c) permits a further improvement in detergency to oil and grease smears, in particular, smears of sebum.

Particularly preferable examples of the anionic surfactant having a polyoxyalkylene group of the component (d) include polyoxyalkylene alkyl ether sulfates, polyoxyalkylene alkenyl ether sulfates, polyoxyalkylene alkyl ether acetates and polyoxyalkylene alkenyl ether acetates.

The alkyl or alkenyl groups in these anionic surfactants are preferably those having 4–26 carbon atoms, more preferably 8–24 carbon atoms. These alkyl or alkenyl groups may be either linear or branched. Examples of the polyoxyalkylene groups in the anionic surfactants include polyoxyethylene, polyoxypropylene and polyoxybutylene groups. Of these, the polyoxyethylene group and/or the polyoxypropylene group is particularly preferred. The average number of moles of the polyoxyalkylene group added is preferably 1–20, in particularly 1–10. Examples of salts of the anionic surfactants include salts with alkali metals such as sodium and potassium, salts with alkaline earth metals such as calcium and magnesium, ammonium salts, and salt with alkanolamines such as monoethanol-amine, diethanolamine and triethanolamine.

Specific preferable examples of the anionic surfactants include polyoxyethylene (E.O.=1–10) $C_{8-24}$-alkyl ether sulfates and polyoxyethylene (E.O.=1–10) $C_{8-24}$-alkyl ether acetates.

The component (d) is preferably incorporated in a proportion of 0.1–20 wt. %, more preferably 0.3–15 wt. %, most preferably 0.5–10 wt. % of the composition according to the present invention from the viewpoint of detergency to sebum smears and storage stability.

The blending proportion of component (a) to component (d) is preferably 3/7 to 7/3, more preferably 4/6 to 6/4 in terms of molar ratio from the viewpoint of detergency to sebum smears of the resulting composition.

In general, the combined use of a cationic surfactant and an anionic surfactant results in formation of a complex. Therefore, precipitate tends to form, which may offer a problem from the viewpoint of storage stability. However, the use of the anionic surfactant having a polyoxyalkylene group makes the complex-forming ability low, and hence is favorable to storage stability.

In the detergent composition for hard surfaces according to the present invention, it is preferable to incorporate a nonionic surfactant and/or an amphoteric surfactant as a component (e) with a view toward still further improving the detergency to sebum smears and preventing deterioration of performance during long-term storage at a high temperature.

Preferable examples of such a nonionic surfactant include the following compounds (i) to (iv), with the compounds (iv) being particularly preferred.

(i) Polyoxyethylene alkyl ethers or polyoxyethylene alkenyl ethers in which the alkyl or alkenyl group thereof has 10–20 carbon atoms on the average, and the number of moles of the polyoxyethylene group added is 1–30 on the average.

(ii) Higher fatty acid alkanolamides represented by the following general formula, or their addition products with alkylene oxides:

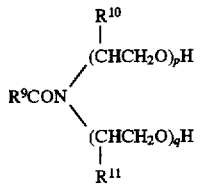

wherein $R^9$ is an alkyl or alkenyl group having 10–20 carbon atoms, $R^{10}$ and $R^{11}$ are the same or different from each other and denote individually H or $CH_3$, and p and q are integers of 1–3 and 0–3, respectively.

(iii) Amine oxides exemplified by alkylamine oxides or alkenylamine oxides having a linear or branched alkyl or alkenyl group having 1–24 carbon atoms. Preferable examples of the amine oxides include alkylamine oxides represented by the following general formula (a):

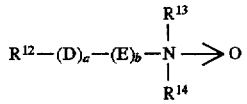

(a)

wherein $R^{12}$ is an alkyl or alkenyl group having 8–24 carbon atoms, $R^{13}$ and $R^{14}$ are identical with or different from each other and denote individually an alkyl group having 1–3 carbon atoms, D is

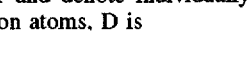

E is an alkylene group having 1–5 carbon atoms, and a and b are equal to each other and stand for 0 or 1.

In the general formula (a), $R_{12}$ may be an alkyl or alkenyl group having 8–24 carbon atoms. However, an alkyl group having 12–18 carbon atoms is particularly preferred. $R^{13}$ and $R^{14}$ may be individually an alkyl group having 1–3 carbon atoms. However, a methyl group is particularly preferred.

(iv) Alkylglycosides exemplified by compounds represented by the following general formula:

$$R^{15}(OR^{16})_xG_y$$

wherein $R^{15}$ means a linear or branched alkyl, alkenyl or alkylphenyl group having 8–18 carbon atoms in total, $R^{16}$ denotes an alkylene group having 2–4 carbon atoms, G is a residue derived from a reducing sugar having 5–6 carbon atoms, and x and y stand for numbers of 0–5 and 1–5 in terms of the average value, respectively.

The value of x is preferably 0–2 from the viewpoint of solubility in water and crystallizability, with 0 being particularly preferred. On the other hand, when y is greater than 1 in terms of the average value, namely, the nonionic surfactant contains a saccharide chain composed of a disaccharide or still higher oligosaccharide as a hydrophilic group. The bond form of the saccharide chain may be a 1–2, 1–3, 1–4 or 1–6 bond, or an alpha- or beta-pyranoside or furanoside bond. It is also possible to contain a saccharide chain having a combination of these bonds. The average value of y in the general formula may be 1–5, preferably 1–1.5, more preferably 1–1.4. Incidentally, y is determined in accordance with the proton NMR method.

Further, $R^{15}$ in the general formula is preferably an alkyl group having 10–14 carbon atoms from the viewpoint of solubility and cleanability. Furthermore, $R^{16}$ is preferably an alkylene group having 2–3 carbon atoms from the viewpoint of solubility in water. Moreover, the structure of G is determined depending upon the raw material to be used, which is a monosaccharide or di- or still higher oligosaccharide. Preferable examples of the raw material for G include glucose and fructose for the monosaccharide, and maltose and sucrose for the di- or still higher oligosaccharide because of their good availability and low cost. Of these, glucose is particularly preferred from the viewpoint of availability.

No particular limitation is imposed on the amphoteric surfactant useful in the practice of the present invention. However, alkylamidocarboxybetaines and alkylamidohydroxysulfobetaines are preferred. In these amphoteric surfactants, those containing a linear or branched alkyl group having 8–24 carbon atoms on the average as a hydrophobic group are preferred.

Among the surfactants for component (e), amphoteric surfactants are preferred for improving the storage stability of the composition according to the present invention, while nonionic surfactants are preferred for improving the detergent effect on sebum smears. Therefore, it is more preferable in the present invention to use these amphoteric and nonionic surfactants in combination.

The component (e) is preferably incorporated in a proportion of 0.1–20 wt. %, more preferably 0.5–10 wt. % of the composition according to the present invention from the viewpoint of the detergency to sebum smears and storage stability.

The detergent composition according to the present invention may contain, for example, an alkalizing agent (0.1–15 wt. %) such as an alkanolamine, a thickener, a pigment, a colorant, a perfume base, a germicide, an antiseptic, and water in an amount sufficient for the total weight of the composition to amount to 100 wt. %.

The detergent composition according to the present invention can be prepared by mixing the above-described components in a method known per se in the art. The pH of the composition is preferably within a range of 3–12, more preferably 5–10, most preferably 6–8. It is not preferable for the composition to have any pH outside the above range because problems of hand roughening and the like arise.

The composition according to the present invention may be used as a detergent for hard surfaces such as tiles, ceramics, enamelware, reinforced plastics (FRP), stainless steel, wood and the like. However, it is preferably used, particularly, for cleansing bathrooms, bathtubs and bath furnaces, namely, as a detergent for bathrooms.

As a cleansing method using the composition according to the present invention, there may be used any method heretofore in common use. For example, it is only necessary to impregnate a sponge or the like with the composition and rub the hard surface to be cleansed in a bathroom or bathtub with the sponge; or to spray the surface to be cleansed with the composition, leave the surface to stand for a while, and then rinse the surface with water. Upon cleansing the inner surface of a bathtub, it is also permissible to add the composition according to the present invention into water remaining in the bathtub after bathing, leaving it to stand for a certain period of time, preferably, at least 1 hour and then discharge the water. Thereafter, if necessary, the surface of the bathtub may be rinsed with water. In this case, it is preferable to add the composition of the present invention in a concentration of 0.5–100 ppm, preferably 10–80 ppm in terms of the cationic surfactant.

The present invention will hereinafter be described in more detail by the following examples. However, it should be kept in mind that the present invention is not limited to and by these examples.

EXAMPLES 1–8 AND COMPARATIVE EXAMPLES 1–3

Detergent compositions having their corresponding formulations shown in Tables 1 and 2 were prepared to evaluate with respect to detergency. The results are shown in Tables 1 and 2. Numerals corresponding to the components in the tables indicate wt. %.

[Evaluation method of detergency]

The evaluation of detergency was performed in the following manner. After a bath basin and a bathroom seat, both, made from polypropylene and soiled by bathing to such an extent that the dirt was not removed simply by rubbing, were brought into close contact with a cloth impregnated with a detergent composition to be tested for several seconds, or were sprayed with the detergent composition, they were lightly rinsed with water, and the condition that the dirt had been removed was visually observed and ranked in 5 grades in accordance with the following standard (in the tables, indicated by an average value of n=5):

5: Dirt was removed to a very good extent;
4: Dirt was removed to a good extent;
3: Dirt was unevenly removed;
2: Dirt was slightly removed; and
1: Dirt was scarcely removed.

TABLE 1

| | | Example | | | | | | | |
|---|---|---|---|---|---|---|---|---|---|
| | Component | 1 | 2 | 3 | 4 | 5 | 6 | 7 | 8 |
| (a) | Dioctyldimethylammonium chloride | 5 | | | | 5 | | | |
| | Didecyldimethylammonium chloride | | 5 | | | | 5 | | |
| | Decyltrimethylammonium chloride | | | 5 | | | | 5 | |
| | Octylbenzyldimethylammonium chloride | | | | 5 | | | | 5 |
| (c) | Diethylene glycol monobutyl ether | 5 | 5 | 5 | 5 | | | | |
| | Dipropylene glycol monobutyl ether | | | | | 5 | 5 | 5 | 5 |
| (b) | EDTA | 2 | 2 | 2 | 2 | 2 | 2 | 2 | 2 |
| Other components: | | | | | | | | | |
| | Water | Bal | Bal | Bal | Bal | Bal | Bal | Bal | Bal |
| | Alkalizing agent (NaOH) | QS | QS | QS | QS | QS | QS | QS | QS |
| | Evaluation of detergency | 5.0 | 5.0 | 4.0 | 5.0 | 5.0 | 5.0 | 4.2 | 5.0 |

Bal: Balance; QS: An amount sufficient to keep pH 7.

TABLE 2

| | Comparative Example | | |
|---|---|---|---|
| Component | 1 | 2 | 3 |
| Na alkyl (c = 13) benzenesulfonate | 5 | | |
| Distearyldimethylammonium chloride | | 5 | |
| Diethylene glycol monobutyl ether | | | 5 |
| EDTA | 2 | 2 | 2 |
| Citric acid | 2 | 2 | 2 |
| Water | Bal | Bal | Bal |
| Alkalizing agent (NaOH) | QS | QS | QS |
| Evaluation of detergency | 3.5 | 2.5 | 2.3 |

Bal: Balance;
QS: An amount sufficient to keep pH 7.

It is understood from Tables 1 and 2 that the detergent compositions according to the present invention have excellent detergency when compared with the case where the quaternary ammonium salt having a long-chain alkyl group wherein the number of carbon atoms is at least 12 is utilized.

When the detergent compositions according to the present invention were used, the surfaces cleansed were not damaged, and irritativeness to the skin was scarcely observed.

EXAMPLES 9–17 AND COMPARATIVE EXAMPLES 4–7

Detergent compositions for bathrooms having their corresponding formulations shown in Tables 3 and 4 were prepared and evaluated with respect to detergency and storage stability. The results are shown in Tables 3 to 5. Numerals corresponding to the components in the tables indicate wt. %. [Evaluation methods of detergency to dirt of metallic soap scum and smears of sebum]

(Detergency to dirt of metallic soap scum)

The evaluation was performed in the following manner. After a bath basin and a bathroom seat, both, made from polypropylene and soiled by bathing to such an extent that the dirt was not removed simply by rubbing were brought into close contact with a cloth impregnated with a detergent composition to be tested for several seconds, or were sprayed with the detergent composition, they were lightly rubbed with the cloth, and the condition that the dirt had been removed was visually observed and ranked in 5 grades in accordance with the following standard (in the tables, indicated by an average value of n=5):

5: Dirt was removed to a very good extent;
4: Dirt was removed to a good extent;
3: Dirt was unevenly removed;
2: Dirt was slightly removed; and
1: Dirt was scarcely removed.

(Detergency to smears of sebum)

After five adults were bathed in a bathtub made of stainless steel, and the bathtub was left to stand overnight, the water in the bathtub was discharged, and the bathtub was air-dried. The dirt thus adhered to the bathtub was used in the evaluation.

A detergent composition to be tested was sprayed on the dirt on the bathtub by a commercially-available sprayer, and the sprayed place was then rubbed with sponge. The thus-treated bathtub was rinsed with water, and the condition that the dirt had been removed was visually observed and ranked in 5 grades in accordance with the following standard (in the tables, indicated by an average value of n=5):

5: Dirt was removed to a very good extent;
4: Dirt was removed to a good extent;
3: Dirt was unevenly removed;
2: Dirt was slightly removed; and
1: Dirt was scarcely removed.

[Storage stability]

The storage stability was ranked in accordance with the following standard:

A: None of turbidity, separation and precipitate were observed even after being stored for 1 month at 40° C.;
B: Turbidity was slightly observed after being stored for 1 month at 40° C., but neither separation nor precipitate was observed;
C: No precipitate occurred right after the preparation of the composition at room temperature, but precipitate was observed after being stored for 1 month at 40° C.; and
D: Both turbidity and precipitate were observed right after the preparation of the composition at room temperature.

TABLE 3

| | Component | Example 9 | 10 | 11 | 12 | 13 | 14 | 15 | 16 | 17 |
|---|---|---|---|---|---|---|---|---|---|---|
| (a) | Octylbenzalkonium chloride | 3 | 3 | 3 | 3 | — | — | — | — | — |
| | Decylbenzalkonium chloride | — | — | — | — | — | — | — | 3 | 3 |
| | Dioctyldimethylammonium chloride | — | — | — | — | 3 | 3 | 3 | — | — |
| (d) | Compound*1 of the following formula | 4 | — | 4 | 5 | — | — | 5 | 5 | — |
| | Compound*2 of the following formula | — | 4 | — | — | 4 | 5 | — | — | 5 |
| | Alkylglycoside*3 | — | — | 2 | — | — | 1 | 1 | 1 | — |
| | Compound*4 of the following formula | — | — | — | — | — | 1 | — | — | — |
| (e) | Compound*5 of the following formula | — | — | — | 2 | — | — | — | 1 | — |
| | Compound*6 of the following formula | — | — | — | — | — | — | 1 | — | 2 |
| (b) | Tetrasodium EDTA | 3 | 2 | 2 | 2 | 3 | 3 | 3 | 2 | 2 |
| | Citric acid | 2 | 2 | 2 | 3 | 2 | 2 | — | 2 | 2 |
| (c) | Diethylene glycol monobutyl ether | 7 | — | — | 7 | — | 7 | 7 | 5 | 10 |
| | 1,3-Dimethyl-2-imidazolidinone | — | 7 | — | — | — | — | — | 5 | — |
| | 3-Methoxy-3-methylbutanol | — | — | 7 | — | — | — | — | — | — |
| | 3-Methyl-1,3-butanediol | — | — | — | — | 7 | — | — | — | — |
| | Water | Bal | Bal | Bal | Bal | Bal | Bal | Bal | Bal | Bal |
| | pH (adjusted with NaOH or HCl) | 6 | 7 | 7 | 8 | 6 | 7 | 8 | 7 | 7 |
| | Detergency to dirt of soap scum | 4.5 | 4.5 | 4.6 | 4.6 | 4.6 | 4.6 | 4.5 | 4.5 | 4.5 |
| | Detergency to sebum smear | 4.5 | 4.5 | 4.9 | 4.7 | 4.5 | 4.9 | 4.8 | 4.8 | 4.8 |
| | Storage stability (40° C., 1 month) | B | B | A | A | B | A | A | A | A |

TABLE 4

| Component | Comp. Example 4 | 5 | 6 | 7 |
|---|---|---|---|---|
| (a) Myristylbenzalkonium chloride | 3 | 3 | — | — |
| Dimyristyldimethylammonium chloride | — | — | 3 | 3 |
| (d') Sodium laurylbenzenesulfonate | 5 | 5 | — | — |
| Sodium lauryl sulfate | — | — | 5 | 5 |
| (e) Alkylglycoside*3 | — | 1 | — | 3 |
| Compound*4 of the following formula | — | — | 2 | 3 |
| (b) Tetrasodium EDTA | 2 | 2 | 2 | 2 |
| Citric acid | 3 | 3 | 3 | 3 |
| (c) Diethylene glycol monobutyl ether | 7 | — | 5 | 5 |
| 3-Methoxy-3-methylbutanol | — | 7 | 5 | 5 |
| Water | Bal | Bal | Bal | Bal |
| pH (adjusted with NaOH or HCl) | 7 | 7 | 6 | 8 |
| Detergency to dirt of soap scum | 2.0 | 2.0 | 2.3 | 2.8 |
| Detergency to sebum smear | 1.2 | 1.2 | 1.1 | 2.0 |
| Storage stability (40° C., 1 month) | D | D | D | C–D |

*3: $C_{12}H_{25}G_{1.3}$ (G: residue of glucose),
*4: $C_{12}H_{25}O$ 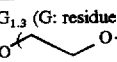 $O\rightarrow_7 H$, Bal: Balance.

It is understood from Tables 3 and 4 that the detergent compositions according to the present invention have excellent detergency to sebum smears compared with the case where an anionic surfactant having no polyoxyalkylene group is incorporated. When the detergent compositions according to the present invention were used, the surfaces cleansed were not damaged, and there were almost no irritation to the skin.

EXAMPLES 18–20

Detergent compositions for bathrooms having their corresponding formulations shown in Table 5 were prepared and evaluated with respect to detergency and storage stability. Incidentally, the evaluation as to the detergency to metallic soap scum and storage stability was performed in the same manner as described above. The results are shown in Table 5. Numerals which correpond to the components in the table indicate wt. %.

TABLE 5

| Component | Example 18 | 19 | 20 |
|---|---|---|---|
| (a) Octylbenzalkonium chloride | 3 | — | — |
| Decylbenzalkonium chloride | — | 3 | — |
| Dioctyldimethylammonium chloride | — | — | 3 |
| (e) Alkylglycoside*3 | — | — | 2 |
| Compound*4 of the following formula | 2 | — | — |
| Compound*5 of the following formula | — | 2 | — |
| Compound*6 of the following formula | — | — | 2 |
| (b) Tetrasodium EDTA | 2 | 2 | 2 |
| Citric acid | 2 | 2 | 2 |
| (c) Diethylene glycol monobutyl ether | — | — | 7 |
| 1,3-Dimethyl-2-imidazolidinone | — | 7 | — |
| 3-Methoxy-3-methylbutanol | 7 | — | — |
| 3-Methyl-1,3-butanediol | — | — | — |
| Water | Bal | Bal | Bal |
| pH (adjusted with NaOH or HCl) | 7 | 6 | 8 |
| Detergency to dirt of soap scum | 4.7 | 4.7 | 4.7 |
| Storage stability (40° C., 1 month) | A | A | A |

*3 $C_{12}H_{25}G_{1.3}$ (G: residue of glucose),

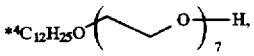

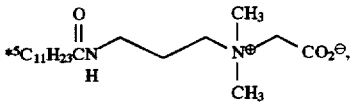

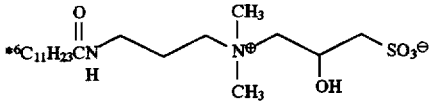

Bal Balance.

It is understood from Table 5 that the detergent compositions according to the present invention have excellent detergency to metallic soap scum. When the detergent compositions according to the present invention were used, the surfaces cleansed were not damaged, and irritation to the skin was scarcely observed. They were also excellent in storage stability.

What is claimed is:

1. A detergent composition for hard surfaces, comprising the following components (a), (b) and (c):

(a) 0.1–30 wt. % of a cationic surfactant represented by the general formula (1):

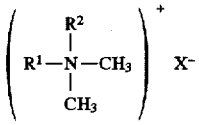

(1)

wherein $R^1$ is a linear or branched alkyl or alkenyl group having 6–11 carbon atoms, $R^2$ is a methyl group;

(b) 0.1–20 wt. % of a sequestering agent; and (c) 0.1–20 wt. % of a water-soluble solvent, selected from the group consisting of compounds represented by the following general formulae (3) through (5):

$$R^4O(C_2H_4O)_m(C_3H_6O)_nR^5 \quad (3)$$

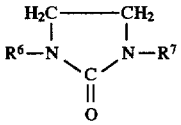

(4)

$$R^8OC(CH_3)_2CH_2CH_2OH \quad (5)$$

wherein $R^4$ and $R^5$ each individually is a hydrogen atom, an alkyl group having 1–4 carbon atoms, a phenyl group or a benzyl group, with the proviso that both groups $R^4$ and $R^5$ cannot be hydrogen atoms at the same time, m and n stand individually for an integer of 0–10, with the proviso that both m and n do not stand for integers of 0 at the same time, $R^6$ and $R^7$ denote individually an alkyl group having 1–3 carbon atoms, and $R^8$ means an alkyl group having 1–3 carbon atoms; said composition having a pH of 3–12.

2. The composition according to claim 1, wherein in formula (1), $R^1$ is a linear alkyl having 8–10 carbon atoms.

3. The composition according to claim 1, wherein component (a) is said cationic surfactant represented by the general formula (2) in which $R^3$ is an alkyl group having 8 carbon atoms.

4. The composition according to claim 1, wherein component (b) is at least one sequestering agent selected from the group consisting of a hydroxycarboxylic acid, an aminocarboxylic acids and salts thereof.

5. The composition according to claim 1, wherein component (b) is at least one sequestering agent selected from the group consisting of ethylenediaminetetraacetic acid, hydroxyethylethylenediaminetriacetic acid, citric acid and salts thereof.

6. The composition according to claim 1, wherein the component (c) is at least one water soluble solvent selected from the group consisting of diethylene glycol monobutyl ether, propylene glycol monomethyl ether, propylene glycol monobutyl ether, dipropylene glycol monobutyl ether, polyoxyethylene glycol phenyl ether, 1,3-dimethyl-2-imidazolidinone, 1,3-diethyl-2-imidazolidinone, 3-methoxy-3-methylbutanol, 3-ethoxy-3-methylbutanol, isoprene glycol, 2,2,4-trimethyl-1,3-pentanediol, methanol, ethanol and isopropyl alcohol.

7. The composition according to claim 1, further comprising an anionic surfactant having a polyoxyalkylene group.

8. The composition according to claim 1, wherein said anionic surfactant having a polyoxyalkylene group is at least one selected from the group consisting of polyoxyalkylene alkyl ether sulfates, polyoxyalkylene alkenyl ether sulfates, polyoxyalkylene alkyl ether acetates and polyoxyalkylene alkenyl ether acetates.

9. The composition according to claim 6, further comprising a nonionic surfactant and/or an amphoteric surfactant.

10. The composition according to claim 9, wherein the nonionic surfactant and/or the amphoteric surfactant is at least one selected from the group consisting of polyoxyethylene alkyl ethers, polyoxyethylene alkenyl ethers, higher fatty acid alkanolamides, amine oxides, alkylglycosides, alkylamidocarboxybetaines and alkylamidohydroxysulfobetaines.

11. A method of cleaning hard surfaces in a bathroom which comprises applying a composition according to claim 1 to said hard surface.

* * * * *

UNITED STATES PATENT AND TRADEMARK OFFICE

CERTIFICATE OF CORRECTION

PATENT NO. : 5,756,443

DATED : May 26, 1998

INVENTOR(S) : Inoue et al.

It is certified that error appears in the above-identified patent and that said Letters Patent is hereby corrected as shown below:

IN THE CLAIMS

Claim 3, Col. 12, line 36,

Line 3, change "formula (2) in which $R^3$ is" to --formula (1) in which $R^1$ is--.

UNITED STATES PATENT AND TRADEMARK OFFICE

CERTIFICATE OF CORRECTION

PATENT NO. : 5,756,443

DATED : May 26, 1998

INVENTOR(S) : Inoue et al

It is certified that error appears in the above-identified patent and that said Letters Patent is hereby corrected as shown below:

Claim 6

Lines 5 and 6, delete "polyoxyethylene glycol phenyl ether,".

Line 8, change "3-methoxy-3-methylbutanol, 3-ethoxy-3-methylbutanol," to --3-methoxy-3-methylbutanol and 3-ethoxy-3-methylbutanol."

Line 9, delete in its entirety.

Line 10, delete in its entirety.

Signed and Sealed this

Second Day of March, 1999

*Attest:*

*Attesting Officer*

Q. TODD DICKINSON

*Acting Commissioner of Patents and Trademarks*